US006929501B2

(12) United States Patent
Huang

(10) Patent No.: US 6,929,501 B2
(45) Date of Patent: Aug. 16, 2005

(54) ELECTRICAL CONNECTOR ASSEMBLY HAVING SLEEVE UNITS THAT PREVENT RELATIVE MOVEMENT BETWEEN TWO ELECTRICAL CONNECTORS IN A TRANSVERSE DIRECTION OF CONTACT PINS

(76) Inventor: George Ying-Liang Huang, 8F, No. 435, Rei-Kuang Rd., Nei-Hu Dist., Taipei (TW)

( * ) Notice: Subject to any disclaimer, the term of this patent is extended or adjusted under 35 U.S.C. 154(b) by 0 days.

(21) Appl. No.: 10/673,202

(22) Filed: Sep. 30, 2003

(65) Prior Publication Data

US 2005/0070145 A1 Mar. 31, 2005

(51) Int. Cl.[7] ..... H01R 13/627
(52) U.S. Cl. ..... 439/362; 439/246
(58) Field of Search ..... 439/246–249, 439/361–362, 365, 677, 953; 361/686

(56) References Cited

U.S. PATENT DOCUMENTS

| | | | | | |
|---|---|---|---|---|---|
| 3,582,867 | A | * | 6/1971 | Thompson et al. | 439/362 |
| 4,952,175 | A | * | 8/1990 | Waters et al. | 439/681 |
| 6,203,333 | B1 | * | 3/2001 | Medina et al. | 439/76.1 |
| 6,522,532 | B2 | * | 2/2003 | Liao et al. | 361/686 |
| 6,554,635 | B2 | * | 4/2003 | Ayers et al. | 439/362 |

* cited by examiner

*Primary Examiner*—Michael C. Zarroli
(74) *Attorney, Agent, or Firm*—Finnegan, Henderson, Farabow, Garrett & Dunner, L.L.P.

(57) ABSTRACT

An electrical connector assembly includes first and second electrical connectors that are interconnected electrically by engagement of pins and pins holes. The first electrical connector further includes two sleeve units sleeved fittingly and respectively on two positioning members of the second electrical connector to prevent relative movement between the first and second electrical connectors in a transverse direction of the contact pins.

5 Claims, 6 Drawing Sheets

ELECTRICAL CONNECTOR ASSEMBLY HAVING SLEEVE UNITS THAT PREVENT RELATIVE MOVEMENT BETWEEN TWO ELECTRICAL CONNECTORS IN A TRANSVERSE DIRECTION OF CONTACT PINS

BACKGROUND OF THE INVENTION

1. Field of the Invention

The invention relates to an electrical connector assembly, more particularly to an electrical connector assembly with two electrical connectors, one of which has two sleeve units, and the other one of which has two positioning members inserted fittingly and respectively into the sleeve units to prevent relative movement between the two electrical connectors.

2. Description of the Related Art

Referring to FIG. 1, a conventional electrical connector assembly includes a first electrical connector 7 connected to an electrical cable 9 of a computer peripheral device (not shown), and a second electrical connector 8 connected to a host module of a computer (not shown). The first electrical connector 7 has a first housing 71, and a first engaging portion 72 disposed on one end of the first housing 71. The first engaging portion 72 includes an annular outer frame 721 with a trapezoidal cross-section, and a plurality of parallel contact pins 722 disposed within the outer frame 71. The second electrical connector 8 includes a blocking portion 81, and a second engaging portion 82 extending from the blocking portion 81. The second engaging portion 82 has a connecting frame 821 with a trapezoidal cross-section, and an outer end surface formed with a plurality of pin holes 822 for insertion of the contact pins 722 therein. A plurality of contact terminals (not shown) are provided inside the pin holes 822 for electrical contact with the contact pins 722 so that when the first engaging portion 72 is coupled to the second engaging portion 82, the first electrical connector 7 is connected electrically to the second electrical connector 8.

Since the coupling between the first and second engaging portions 72, 82 is inadequate to interconnect fixedly the first and second electrical connectors 7, 8, retaining units are further provided on the blocking portion 81 of the second electrical connector 8. The retaining units are two hexagonal nuts 811 disposed fixedly on the blocking portion 81 and located respectively on two opposite sides of the second engaging portion 82. The first housing 71 is provided with two bolts 711, which engage threadedly and respectively the nuts 811 so as to interconnect fixedly the first and second electrical connectors 7, 8.

However, in actual use, the connection between the first and second electrical connectors 7, 8 is rather troublesome and time consuming. Furthermore, since the electrical cable 9 of the computer peripheral device, such as a printer, a projector, or a flat panel plasma display, is frequently connected to and disconnected from the host module of the computer, the bolts 711 on the first housing 71 are usually not completely threaded to the nuts 811 such that when the cable 9 is accidentally pushed or pulled, a small relative swinging movement will take place between the first and second electrical connectors 7, 8 that may result in separation of the same. Moreover, even if the connectors 7, 8 do not separate from each other, errors are likely to be introduced during transmission of a high-speed or high frequency signal.

SUMMARY OF THE INVENTION

Therefore, the object of the present invention is to provide an electrical connector assembly that is capable of overcoming the aforementioned drawbacks of the prior art.

According to this invention, an electrical connector assembly comprises a first electrical connector and a second electrical connector having one end adapted to be connected to an electronic device and the other end connected detachably to the first electrical connector. The first electrical connector includes a first housing, a first engaging portion extending outwardly from the first housing, and a fixing unit disposed on the first housing and located adjacent to the first engaging portion. The second electrical connector includes a second housing, a second engaging portion that extends outwardly from the second housing and that is connected to the first engaging portion, and a positioning member disposed fixedly on the second housing and located adjacent to the second engaging portion. One of the first and second engaging portions includes a plurality of parallel contact pins disposed fixedly thereon. The other one of the first and second engaging portions includes a plurality of pin holes formed therein for receiving respectively the contact pins therein to form an electrical connection between the first and second electrical connectors. The positioning member engages the fixing unit so as to prevent relative movement between the first and second electrical connectors in an axial direction of the pins. The first electrical connector further includes a sleeve unit disposed fixedly on the first housing around the fixing unit. The sleeve unit is sleeved fittingly on the positioning member when the first engaging portion and the second engaging portion are interconnected, whereby relative movement between the first and second electrical connectors in a transverse direction of the contact pins is prevented.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
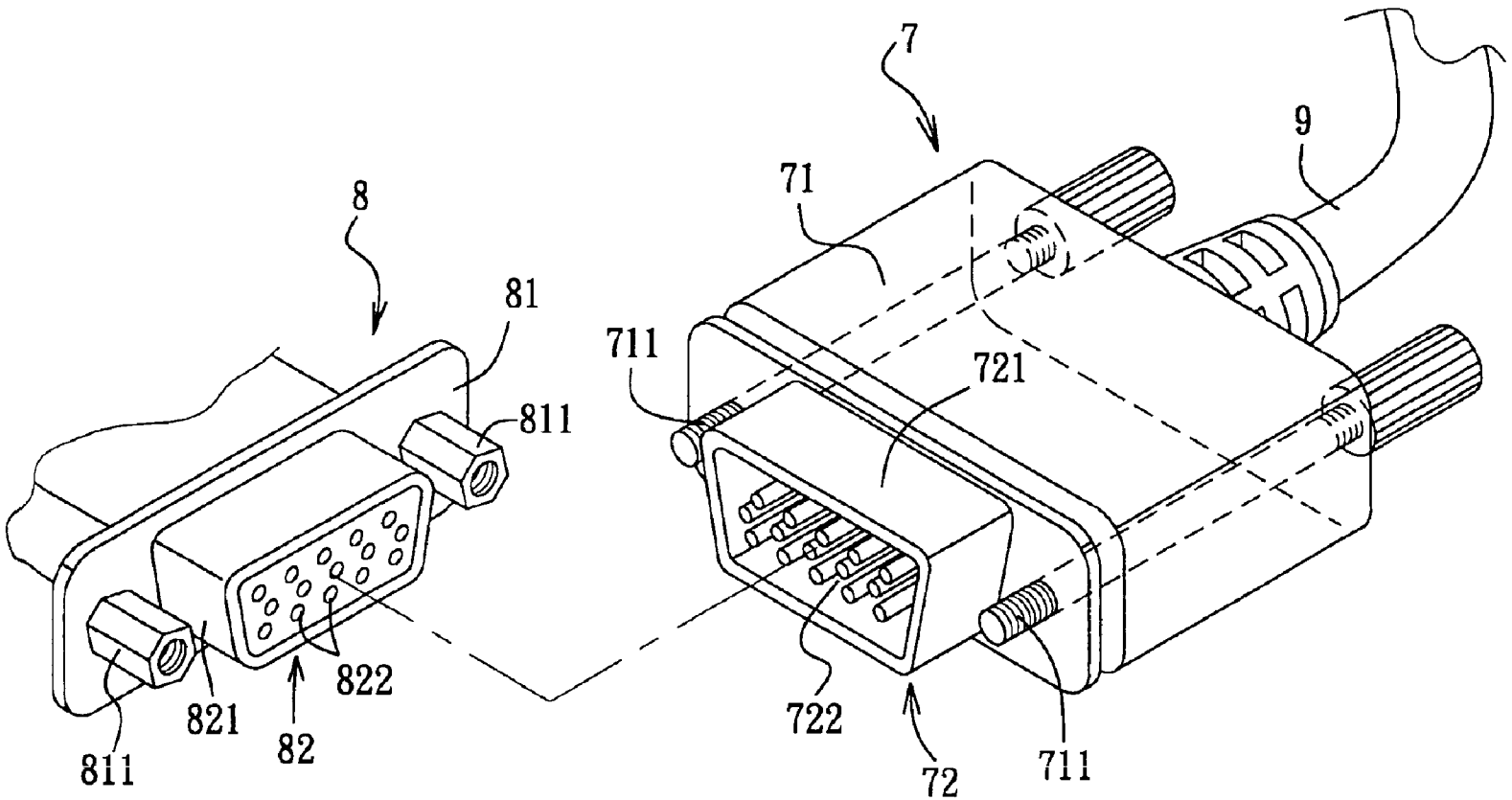
FIG. 1 PRIOR ART
FIG. 1 is a partly exploded perspective view of a conventional electrical connector assembly.

Before the present invention is described in greater detail, it should be noted that like elements are denoted by the same reference numerals throughout the disclosure.

Figure 2:
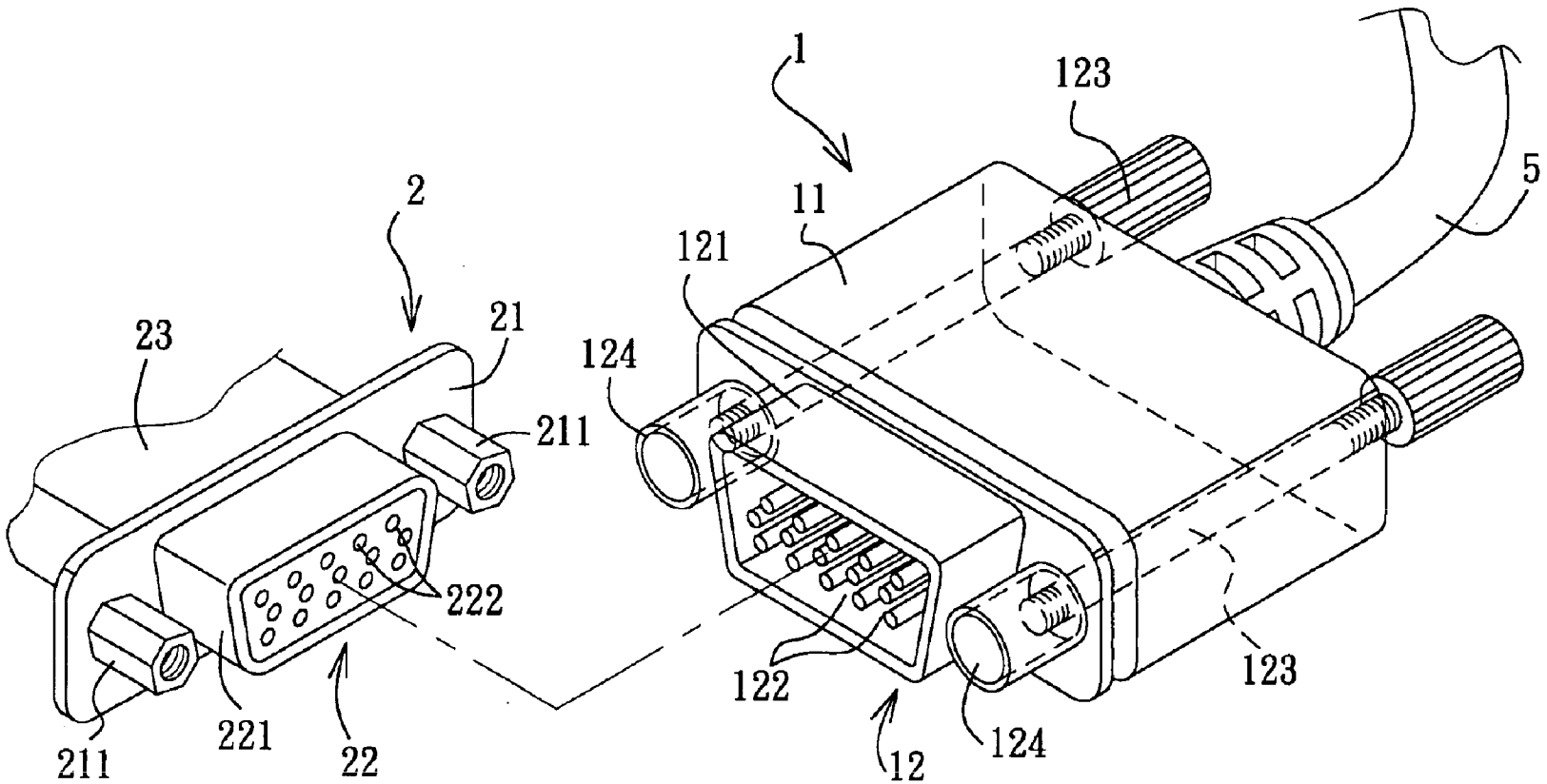
FIG. 2 is a partly exploded perspective view of the first preferred embodiment of an electrical connector assembly according to the present invention.
Figure 3:
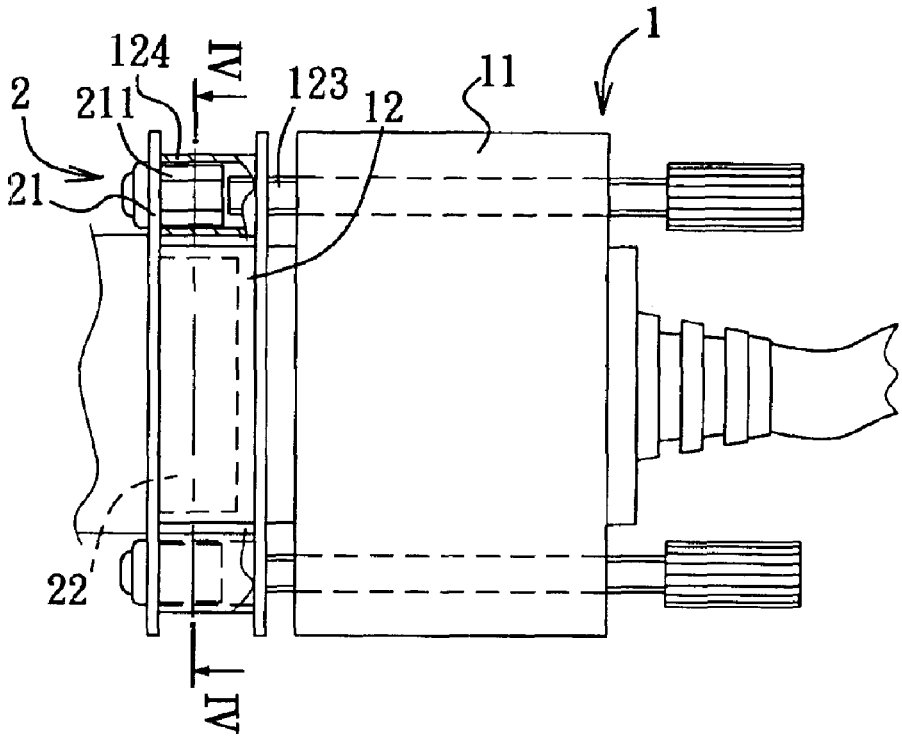
FIG. 3 is a schematic top view, illustrating connection between the first and second electrical connectors of the first preferred embodiment.
Figure 4:
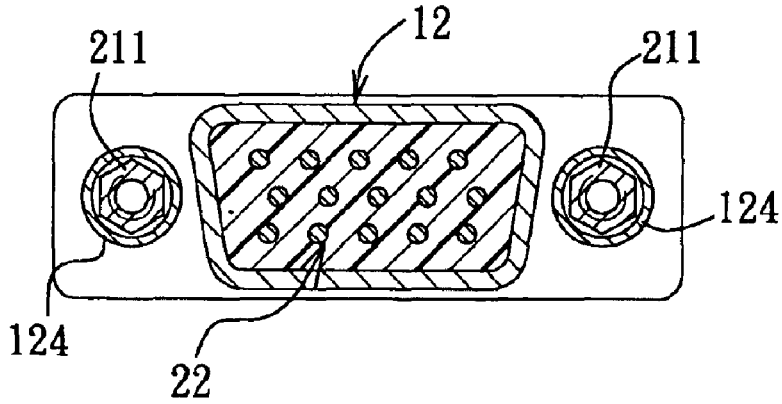
FIG. 4 is a sectional view of the first preferred embodiment, taken along line IV—IV of FIG. 3.

Referring to FIGS. 2 to 4, the first preferred embodiment of an electrical connector assembly according to the present invention is shown to comprise a first electrical connector 1 and a second electrical connector 2.

The first electrical connector 1 is adapted to be connected to an electrical cable 5 of a computer peripheral device, such as a printer (not shown), and includes a first housing 11, and a first engaging portion 12 extending outwardly from the first housing 11. The first housing 11 has two opposite sides, each of which is provided with a fixing unit 123 or a movable and rotatable bolt in a known manner. The first engaging portion 12 includes an annular outer frame 121 with a trapezoidal cross-section, and a plurality of parallel contact pins 122 disposed fixedly within the outer frame 121. The first electrical connector 1 further includes two sleeve units 124, each of which is disposed fixedly on the first housing 11 around the fixing unit 123 and located on each side of the first engaging portion 12. In this embodiment, each of the sleeve units 124 is constructed as a circular sleeve.

The second electrical connector 2 has one end adapted to be connected to an electronic device, such as a computer (not shown), and the other end connected detachably to the first electrical connector 1. The second electrical connector 2 includes a second housing 23 with a flanged end 21, a second engaging portion 22 that extends from the flanged end 21 and that is connected to the first engaging portion 12 of the first electrical connector 1, and two positioning members 211 disposed fixedly on the second housing 23 and located respectively on two opposite sides of the second engaging portion 22. The second engaging portion 22 includes an annular connecting frame 221, on which the outer frame 121 of the first electrical connector 1 is sleeved in a known manner so as to prevent electromagnetic interference, and a plurality of pin holes 222 formed in the second engaging portion 22 for insertion of the contact pins 122 therein so as to form an electrical connection between the first and second electrical connectors 1, 2. In this embodiment, each of the positioning members 211 is constructed as a hexagonal nut. The fixing units 123 engage the positioning members 211 so as to prevent relative movement of the first and second electrical connectors 1, 2 in an axial direction of the pins 122 even when the fixing units 123 engage the positioning members 211 in an incomplete manner.

The sleeve units 124 of the first electrical connector 1 are sleeved fittingly and respectively on the positioning members 211 of the second electrical connector 2 when the first engaging portion 12 and the second engaging portion 22 are interconnected so as to prevent relative movement between the first and second electrical connectors 1, 2 in a transverse direction of the contact pins 122.

In use, when the first engaging portion 12 of the first electrical connector 1 is connected to the second engaging portion 22 of the second electrical connector 2, each sleeve unit 124 is fitted on the corresponding positioning member 211 at the same time. As such, when the cable 5 accidentally swings or bends, due to the limited space between each sleeve unit 124 and the corresponding positioning member 211, the first electrical connector 1 will not be easily separated from the second electrical connector 2. This can prevent possible opening of the circuit. Since just a sleeving action is necessary to connect the sleeve units 124 with the respective positioning members 211, the first and second electrical connectors 1, 2 can be fitted together or released from each other through a quick inserting or releasing action. Even if the fixing units 123 and the positioning members 211 are not inter-engaged, the connection between the first and second electrical connectors 1, 2 can be stabilized. This construction is advantageous especially for portable projectors and other electronic devices.

Accordingly, the electrical connector assembly of the present invention is very convenient and easy to use.

Figure 5:
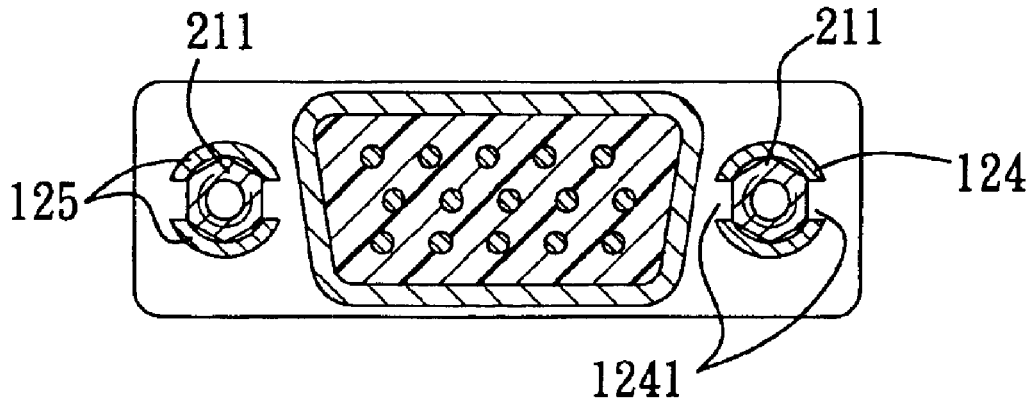
FIG. 5 is a sectional view of the second preferred embodiment of an electrical connector assembly according to the present invention.

Referring to FIG. 5, the second preferred embodiment of an electrical connector assembly according to the present invention is shown to be substantially similar to the first preferred embodiment. However, in this embodiment, each of the sleeve units 124 includes two diametrically opposed notches 1241 that divide each of the sleeve units 124 into two arcuate ribs 125, which are sleeved fittingly and respectively on the positioning members 211, thereby achieving a similar advantageous effect as that of the first preferred embodiment.

Figure 6:
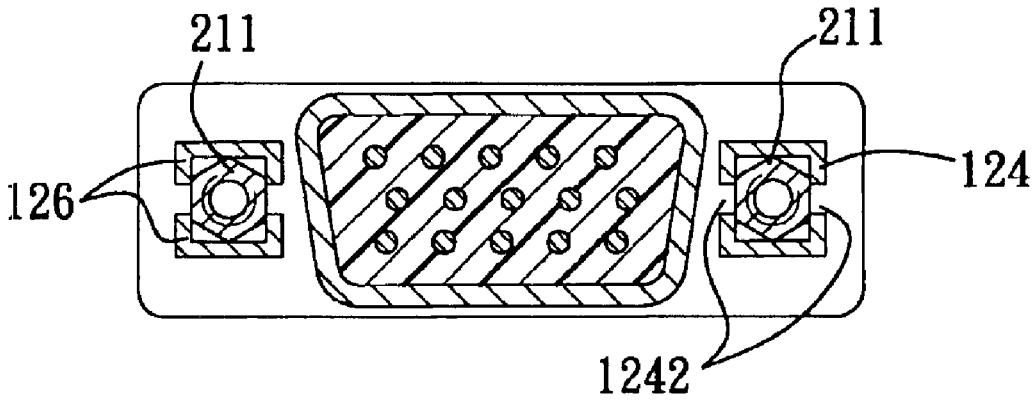
FIG. 6 is a sectional view of the third preferred embodiment of an electrical connector assembly according to the present invention.

The third preferred embodiment of an electrical connector assembly according to the present invention is shown in FIG. 6 to be substantially similar to the first preferred embodiment. However, in this embodiment, each of the sleeve units 124 is generally rectangular, and has two opposite notches 1242 that divide each of the sleeve units 124 into two opposite U-shaped ribs 126, which are sleeved fittingly on a corresponding one of the positioning members 211, thereby achieving the same positioning effect as that of the first preferred embodiment.

Figure 7:
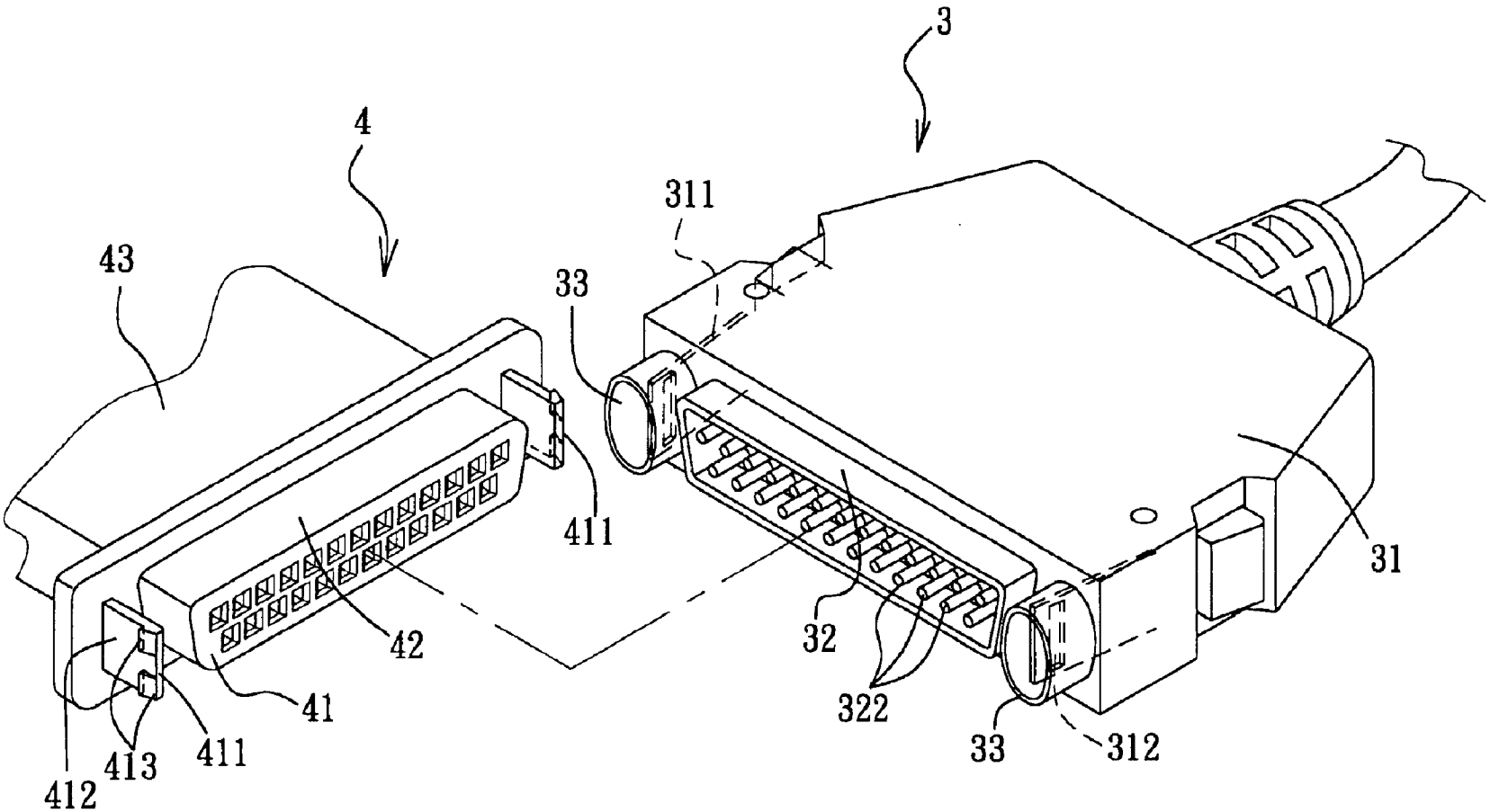
FIG. 7 is a partly exploded perspective view of the fourth preferred embodiment of an electrical connector assembly according to the present invention.
Figure 8:
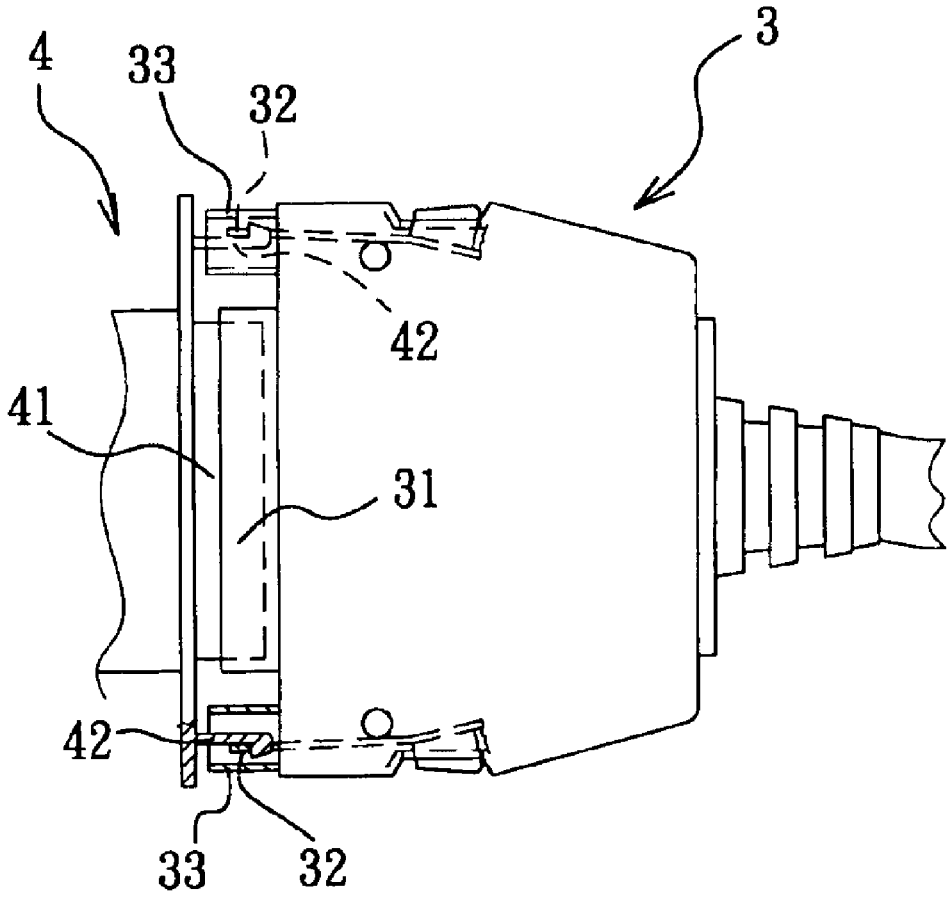
FIG. 8 is a schematic top view, illustrating connection between the first and second electrical connectors of the fourth preferred embodiment.

Referring to FIGS. 7 and 8, the fourth preferred embodiment of an electrical connector assembly according to the present invention is adapted to be applied to electrical connectors of SCSI specifications, and is shown to comprise first and second electrical connectors 3, 4. The first electrical connector 3 includes a first housing 31, a first engaging portion 32 including a plurality of parallel contact pins 322, and two sleeve units 33 disposed respectively on two opposite sides of the first engaging portion 32. In this embodiment, each of the sleeve units 33 is constructed as an elliptical sleeve. The first housing 31 has two opposite sides, each of which is provided with a resilient fixing unit 311. Each resilient fixing unit 311 has an end portion that extends into a corresponding sleeve unit 33 and that is formed with a slot 312.

The second electrical connector 4 includes a second housing 43, a second engaging portion 42 connected to the first engaging portion 32, and two positioning members 411 disposed on the second housing 43 and located respectively on two opposite sides of the second engaging portion 42. In this embodiment, each of the positioning members 411 is generally shaped as a plate 412 that is parallel to the contact pins 322. Each sleeve unit 33 is sleeved around a respective one of the plates 412 when the first and second electrical connectors 1, 2 are interconnected. The plate 412 has a pair of hooking ends 413 that engage the slot 312 in a respective one of the fixing units 311.

Alternatively, like the sleeve units 124 shown in FIG. 5, each of the sleeve units 33 can be formed with two notches (not shown) that divide each of the sleeve units 33 into two opposite arcuate ribs (not shown).

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An electrical connector assembly comprising:

a first electrical connector including a first housing, a first engaging portion extending outwardly from said first housing, and a fixing unit disposed on said first housing and located adjacent to said first engaging portion; and a second electrical connector having one end adapted to be connected to an electronic device and the other end connected detachably to said first electrical connector, said second electrical connector including a second housing, a second engaging portion that extends outwardly from said second housing and that is connected to said first engaging portion, and a positioning member disposed fixedly on said second housing and located adjacent to said second engaging portion;

wherein one of said first and second engaging portions includes a plurality of parallel contact pins disposed fixedly thereon, and the other one of said first and second engaging portions includes a plurality of pin holes formed therein for receiving respectively said contact pins therein to form an electrical connection between said first and second electrical connectors, said positioning member engaging said fixing unit so as to prevent relative movement between said first and second electrical connectors in an axial direction of said pins;

wherein said first electrical connector further includes a sleeve unit disposed fixedly on said first housing around said fixing unit, said sleeve unit being sleeved fittingly on said positioning member when said first engaging portion and said second engaging portion are interconnected, whereby relative movement between said first and second electrical connectors in a transverse direction of said contact pins is prevented;

wherein said positioning member is constructed as a hexagonal nut, said sleeve unit being constructed as a sleeve; and wherein said fixing unit is a bolt that is disposed movably and rotatably in said first housing and that extends into said sleeve unit, the length of said sleeve unit that protrudes out from said first housing being less than or equal to the length of said first engaging portion that protrudes out of said first housing.

2. The electrical connector assembly as claimed in claim 1, wherein said sleeve is circular.

3. The electrical connector assembly as claimed in claim 2, wherein said sleeve includes two diametrically opposed notches that divide said sleeve into two opposite arcuate ribs.

4. The electrical connector assembly as claimed in claim 1, wherein said sleeve is generally rectangular, and has two opposite notches that divide said sleeve into two opposite U-shaped ribs.

5. An electrical connector assembly comprising:

a first electrical connector including a first housing, a first engaging portion extending outwardly from said first housing, and a fixing unit disposed on said first housing and located adjacent to said first engaging portion; and a second electrical connector having one end adapted to be connected to an electronic device and the other end connected detachably to said first electrical connector, said second electrical connector including a second housing, a second engaging portion that extends outwardly from said second housing and that is connected to said first engaging portion, and a positioning member disposed fixedly on said second housing and located adjacent to said second engaging portion;

wherein one of said first and second engaging portions includes a plurality of parallel contact pins disposed fixedly thereon, and the other one of said first and second engaging portions includes a plurality of pin holes formed thereon for receiving respectively said contact pins therein to form an electrical connection between said first and second electrical connectors, said positioning member engaging said fixing unit so as to prevent relative movement between said first and second electrical connectors in an axial direction of said pins;

wherein said first electrical connector further includes a sleeve unit disposed fixedly on said first housing around said fixing unit, said sleeve unit being sleeved fittingly on said positioning member when said first engaging portion and said second engaging portion are interconnected, wherein relative movement between said first and second electrical connectors in a transverse direction of said contact pins is prevented; and wherein said positioning member is generally shaped as a plate that is parallel to said contact pins, said plate having a hooking end, said fixing unit having a slot to engage said hooking end, said sleeve unit being constructed as an elliptical sleeve to sleeve around said plate.

* * * * *